United States Patent [19]

Conner, Jr.

[11] 4,097,967

[45] Jul. 4, 1978

[54] SNAP LOCK STRUCTURE

[76] Inventor: William Nicholas Conner, Jr., 439 Westfield Ct., Wichita, Kans. 67212

[21] Appl. No.: 789,107

[22] Filed: Apr. 20, 1977

[51] Int. Cl.[2] ..... B65D 77/10

[52] U.S. Cl. ..... 24/30.5 R; 24/261 R; 24/262; 24/255 SL

[58] Field of Search ..... 24/30.5 R, 30.5 S, 30.5 T, 24/30.5 L, 262, 261 R, 261 C, 255 SL, 27; 229/62, 65

[56] References Cited

U.S. PATENT DOCUMENTS

| | | | |
|---|---|---|---|
| 1,780,880 | 11/1930 | Johnson | 24/30.5 R |
| 2,628,396 | 2/1953 | Grimes et al. | 229/65 UX |
| 2,653,048 | 9/1953 | Novak | 24/261 C |
| 3,604,066 | 9/1971 | Moon | 24/30.5 R |
| 3,629,905 | 12/1971 | Cote | 24/30.5 R |
| 3,937,394 | 2/1976 | Netschert | 229/65 X |

FOREIGN PATENT DOCUMENTS

| | | | |
|---|---|---|---|
| 226,141 | 2/1925 | United Kingdom | 24/261 C |

*Primary Examiner*—Werner H. Schroeder
*Assistant Examiner*—Moshe I. Cohen
*Attorney, Agent, or Firm*—Phillip A. Rein

[57] ABSTRACT

This invention is a snap lock structure used with paper or plastic bag members to close an open end in a sealed, airtight manner. The snap lock structure includes an upper clamp member integral through a connector section with a lower clamp member. The upper and lower clamp members are similar, each having a main body and outer clamp sections. The upper clamp member has an outer lock head portion which engages in a locked condition a lock receiver portion of the lower clamp member. The connector section has a shield member to maintain the bag members in proper position for clamping.

7 Claims, 6 Drawing Figures

SNAP LOCK STRUCTURE

Numerous types of locking members are known to the prior art operable to seal bag members but none are operable in a manner similar to applicant's invention. None of the prior art devices are operable in a positive manner to provide a positive seal and clamping action along its entire length.

In one preferred embodiment of this invention, a snap lock structure is provided attachable to the open end portion of a bag structure or other similar items. The snap lock structure includes an upper clamp member secured through a connector section to a lower clamp member. The upper clamp member includes a main clamp body integral with a clamp section which, in turn, has a lock head portion on an outer end thereof. The lower clamp member is similar to the upper clamp member including a main body clamp integral with a connector clamp section which, in turn, has a lock receiver portion on an outer end thereof. The lock head portion and lock receiver portion cooperate in a clamped position to bias the main clamp body and the main body clamp toward each other. The connector section is a flexible or living hinge type having a shield member to keep the bag member in the proper position for clamping.

One object of this invention is to provide a snap lock structure easily secured on bag type structure which is economical to manufacture, durable in construction, and easy to use.

One other object of this invention is to provide a snap lock structure operable to form a biased, clamping action about the open end portion of a bag structure.

Still, another object of this invention is to provide a snap lock structure having a locking assembly that provides a positive biasing effect to hold in the clamped condition.

Various other objects, advantages, and features of the invention will become apparent to those skilled in the art from the following discussion, taken in conjunction with the accompanying drawings, in which.

The following is a discussion and description of preferred specific embodiments of the new snap lock structure of this invention, such being made with reference to the drawings, whereupon the same reference numerals are used to indicate the same or similar parts and/or structure.

Figure 1:
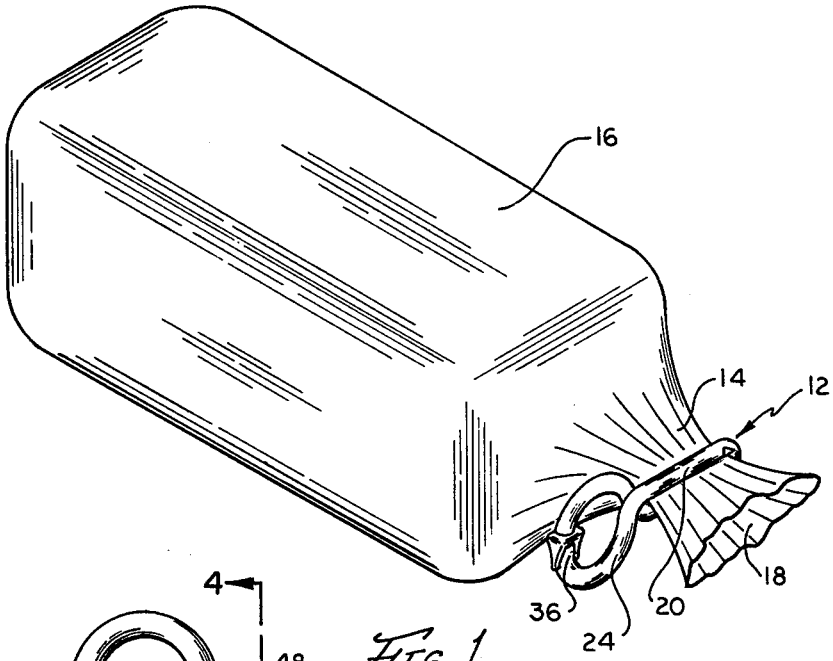
FIG. 1 is a perspective view of the snap lock structure of this invention as attached to a plastic bag in the clamped condition.

Referring to the drawings in detail and in particular to FIG. 1, a snap lock structure of this invention, indicated generally at 12, is shown as attached to a neck portion 14 of a bag structure 16. As noted by shape of the bag structure 16, the same may contain sliced bread with access thereto through an opening 18. The use of the snap lock structure 12 is to tightly clamp the neck portion 14 to create an airtight seal to prevent drying out of the bread slices.

Figure 5:
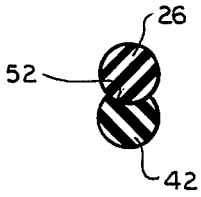
FIG. 5 is a sectional view taken along line 5—5 in FIG. 2.

The snap lock structure 12 includes an upper clamp member 20 secured through a connector section 22 to a lower clamp member 24. The upper clamp member 20 includes a main clamp body 26 integral with a clamp section 28 which, in turn, is secured to lock receiver portion 30. The main clamp body 26 has an integral offset portion 32 integral with the clamp section 28 for reasons to be explained. Also, the main body clamp 26, offset portion 32, and clamp section 28 are circular in transverse cross section as shown in FIG. 5.

The lock receiver portion 30 includes an endwall 32 having an elongated slot 34 therein and a stop wall 36 integral therewith. The slot 34 has opposed curved wall sections 38.

The lower clamp member 24 is similar to the upper clamp member 20 including a main body clamp 42 integral with a connector clamp section 44 which, in turn, is secured to a lock head portion 46. The main body clamp 42 has an integral offset section 48 integral with the connector clamp section 44 for reasons to be explained. The main body clamp 42 is of generally circular shape in transverse cross section (FIG. 5) except having a semi-circular cut-out 52 to receive the main clamp body 26 therein as will be explained. The connector clamp section 44 and the clamp section 28 are substantially identical.

Figure 2:
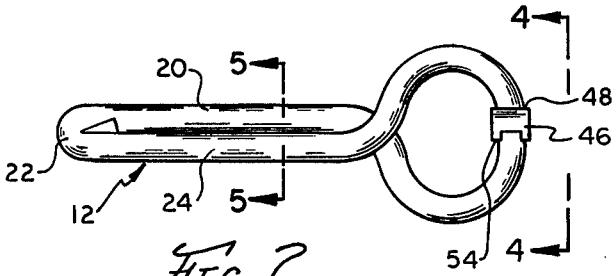
FIG. 2 is a side elevational view of the snap lock structure of this invention.
Figure 4:
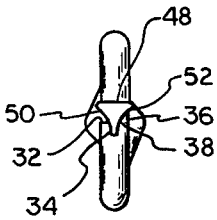
FIG. 4 is an open end plan view taken along line 4—4 in FIG. 2.

As seen in FIGS. 2 and 4, the lock head portion 46 is of a blade edge shape with a top wall 48, arcuate sidewalls 50, 52 and a knife edge 54. The sidewalls 50, 52 are of substantial width to lock with the lower clamp member 24 in a manner to be explained.

Figure 3:
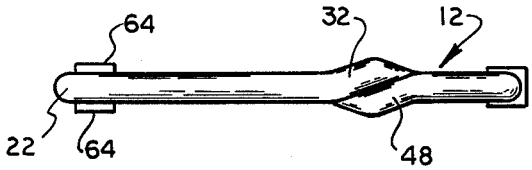
FIG. 3 is a top plan view of the snap lock structure of this invention.
Figure 6:
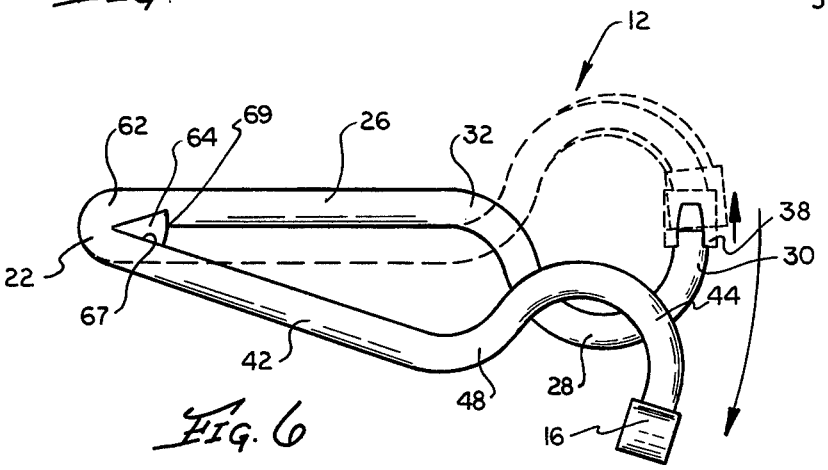
FIG. 6 is a view similar to FIG. 2 showing the snap lock structure in the unlatched condition and latched condition in dotted lines.

As shown in FIGS. 3 and 6, the connector section 22 includes a connector portion 62 securing the main clamp body 26 to the main body clamp 42 and having a shield member 64 on upper and lower sides thereof. The connector portion 62 forms a living hinge connection which is freely movable but biases the upper clamp member 20 and the lower clamp member 24 to the latched condition of FIG. 5.

Respective ones of the shield members 64 are secured to the main clamp body 26 and the main body clamp 42 and are of generally V-shape. More particularly, each shield member 64 has a connector leg edge 67 integral with a curved peripherial edge 69 for reasons to be explained.

In the use and operation of the snap lock structure 12 of this invention, this device assumes the position shown in solid lines in FIG. 6 in the unlatched condition. In this open condition, the neck portion 14 of the bag structure 16 can be inserted between the upper clamp member 20 and the lower clamp member 24. Next, the upper clamp member 20 can be moved upwardly and laterally to put the lock head portion 46 into the lock receiver portion 30 as shown in FIG. 1. The shield member 64 keeps the bag structure 16 from gathering in the connector section 22 between the upper clamp member 20 and the lower clamp member 24 to prevent undue load created at this junction. Also, a sharp junction of the upper clamp member 20 and the lower clamp member 24 could possibly tear the bag structure 16 and defeat the purpose of the snap lock structure 12 of this invention.

The offset lock head portion 46 and the lock receiver portion 30 is such that the clamp section 28 and the connector clamp section 44 can easily be grasped in one's fingers for moving to the latched and unlatched positions. As seen in FIG. 5, the cross sectional views of the cooperating main clamp body 26 and the main body clamp 42 is such as to exert even but firm pressure against the neck portion 14 of the bag structure 16 when in the latched condition as shown in FIG. 1.

It is seen that the snap lock structure is simple in construction, easy to use, and can be used over and over to seal various types of bag structures.

While the invention has been described in conjunction with preferred specific embodiments thereof, it will be understood that this description is intended to illustrate and not to limit the scope of the invention, which is defined by the following claims.

I claim:

1. A snap lock structure connectable to a neck portion of a bag structure to provide an airtight seal, comprising:

(a) an upper clamp member secured through a connector section to a lower clamp member;

(b) said upper clamp member having a main clamp body connected through a clamp section to a lock receiver portion;

(c) said lower clamp member having a main body clamp connected through a connector clamp section to a lock head portion;

(d) said lock receiver portion and said lock head portion engaged in a latched condition and biased into engagement by the bag structure; and (e) the bag member in the clamped condition operates to separate said main clamp body and said main body clamp to create a clamping force between said lock receiver portion and said lock head portion to provide the clamping action.

2. A snap lock structure as described in claim 1, wherein:

(a) said lock head portion having curved sidewalls joining to form a blade edge, and (b) said lock receiver portion having a slot therein to receive said blade edge therein in the latched condition and hold said blade edge against lateral movement until intentionally released.

3. A snap lock structure as described in claim 2, wherein:

(a) said lock receiver portion having an upright stop wall to direct said blade edge into said slot.

4. A snap lock structure as described in claim 1, wherein:

(a) said clamp section and said connector clamp section extended outwardly and laterally of said main clamp body and said main body clamp, respectively, so as to be easily grasped by one's fingers to move from latched to unlatched conditions.

5. A snap lock structure as described in claim 4, wherein:

(a) said lock head portion having curved sidewalls joining to form a blade edge; and (b) said lock receiver portion having a slot therein to receive said blade edge therein in the latched condition.

6. A snap lock structure as described in claim 1, wherein:

(a) said lock head portion having a top wall, inclined sidewalls connected to said top wall, and a blade edge formed by the junction of said sidewalls; and (b) said lock receiver portion having a top wall, a connector slot in said top wall, and an upwardly extended stop wall connected to said top wall;

whereby said stop wall directs said blade edge into said connector slot in the latched condition.

7. A snap lock structure as described in claim 1, wherein:

(a) said main clamp body of circular shape in transverse cross section; and (b) said main body clamp of generally circular shape in transverse cross section except having a semicircular cut-out section which cooperates with an adjacent portion of said main clamp body to achieve a maximum area of contact with the bag member when clamped therebetween.

* * * * *